US007052166B2

(12) United States Patent
Tessnow

(10) Patent No.: US 7,052,166 B2
(45) Date of Patent: May 30, 2006

(54) LIGHT EMITTING DIODE OPTICS

(75) Inventor: Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 69 days.

(21) Appl. No.: 10/846,074

(22) Filed: May 14, 2004

(65) Prior Publication Data

US 2005/0068772 A1 Mar. 31, 2005

Related U.S. Application Data

(60) Provisional application No. 60/507,448, filed on Sep. 30, 2003.

(51) Int. Cl.
*F21S 8/10* (2006.01)

(52) U.S. Cl. ..... 362/545; 362/226; 362/539; 362/547

(58) Field of Classification Search ..... 362/226, 362/545, 539, 547
See application file for complete search history.

(56) References Cited

U.S. PATENT DOCUMENTS

| | | | | |
|---|---|---|---|---|
| 6,641,293 | B1 * | 11/2003 | Kumar et al. | 362/539 |
| 6,682,211 | B1 * | 1/2004 | English et al. | 362/545 |
| 6,773,138 | B1 * | 8/2004 | Coushaine | 362/656 |
| 2003/0063476 | A1 | 4/2003 | English | |

* cited by examiner

*Primary Examiner*—Stephen Husar
*Assistant Examiner*—Anabel Ton
(74) *Attorney, Agent, or Firm*—William E. Meyer

(57) ABSTRACT

A bulb (10) for an automotive taillight has a central stem (12) that includes a base (14), a summit (16), and an intermediate portion (18). A parabolic reflector (20) is positioned about the base (14) and has a first reflector surface (22) facing the summit (16). At least one light source (24) is positioned on the summit (16) for directing primary illumination toward the reflector surface (22) on the reflector (20). In a preferred embodiment of the invention a plurality of light sources (24) are employed to even the distribution of light and the light sources are red light emitting LEDs. An optic (26) is associated with at least a part of the intermediate portion (18), the optic (26) having a second reflector surface (28) for directing secondary illumination toward the first reflector surface (22).

3 Claims, 2 Drawing Sheets

LIGHT EMITTING DIODE OPTICS

CROSS-REFERENCE TO RELATED APPLICATIONS

This application claims priority from Provisional Application No. 60/507,448, filed Sep. 30, 2003.

TECHNICAL FIELD

This invention relates to bulbs and more particularly to bulbs for automotive lighting. Still more particularly it relates to bulbs for use as an automotive taillights using light emitting diodes as the light source.

BACKGROUND ART

Light emitting diodes (LED or LEDs hereafter) have been used in automotive applications such as taillights and center high mount stoplights (CHMSL). The LEDs are favored because of their ruggedness and long life. Current models of LED taillights either mount the LEDs on a metal post on an angle off the axis to achieve an emission pattern away from the axis and to keep emitted light from getting absorbed by the post or use a flat mounted ring of LEDs pointing upwards with the light being directed off axis by a lens, usually of plastic, that produces an emission pattern that is not efficient and is hard to use in reflector optics.

DISCLOSURE OF INVENTION

It is, therefore, an object of the invention to obviate the disadvantages of the prior art.

It is another object of the invention to enhance LED lighting.

It is yet another object of the invention to provide an efficient LED taillight.

These objects are accomplished, in one aspect of the invention, by the provision of a bulb comprising a central stem including a base, a summit, and an intermediate portion. A reflector is positioned about the base and has a first reflector surface facing the summit. At least one light source is positioned on the summit for directing primary illumination toward the reflector surface on the reflector. An optic is associated with at least a part of the intermediate portion, and the optic has a second reflector surface for directing secondary illumination toward the first reflector surface.

BEST MODE FOR CARRYING OUT THE INVENTION

Figure 1:
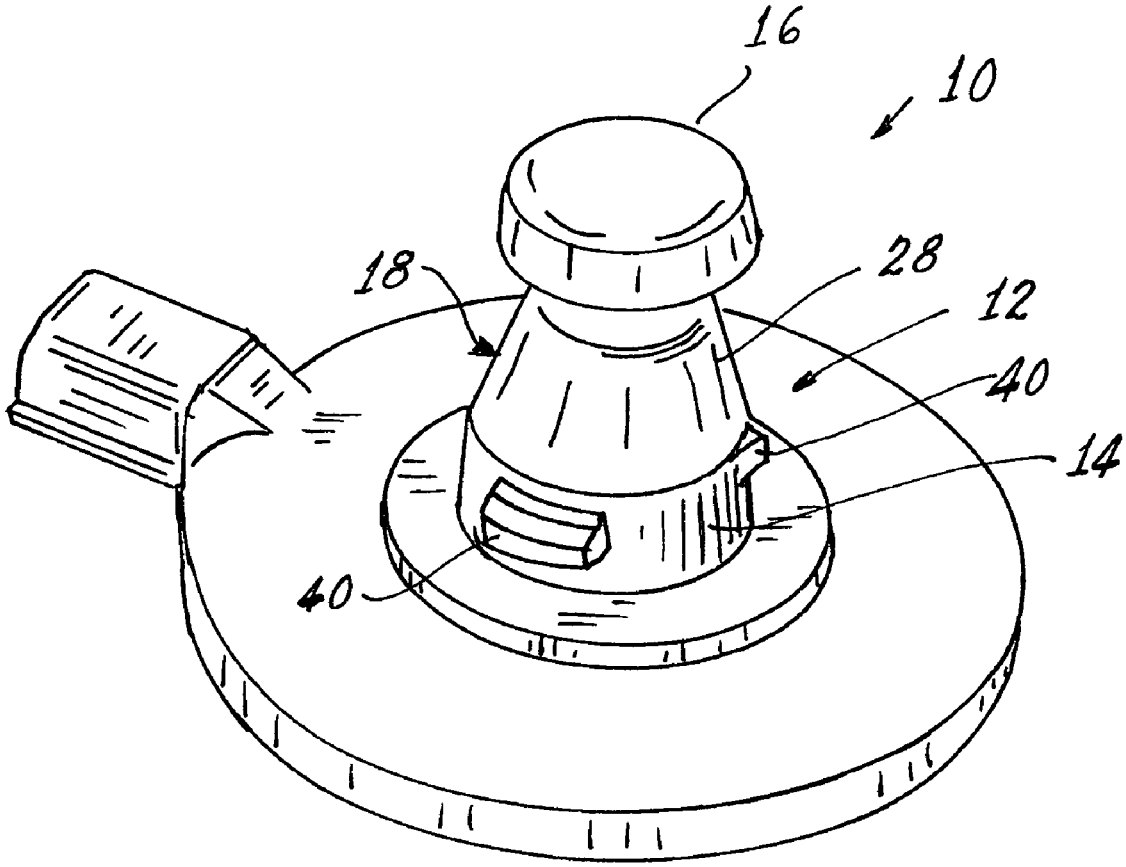
FIG. 1 is a perspective view of a bulb embodying an aspect of the invention.
Figure 2:
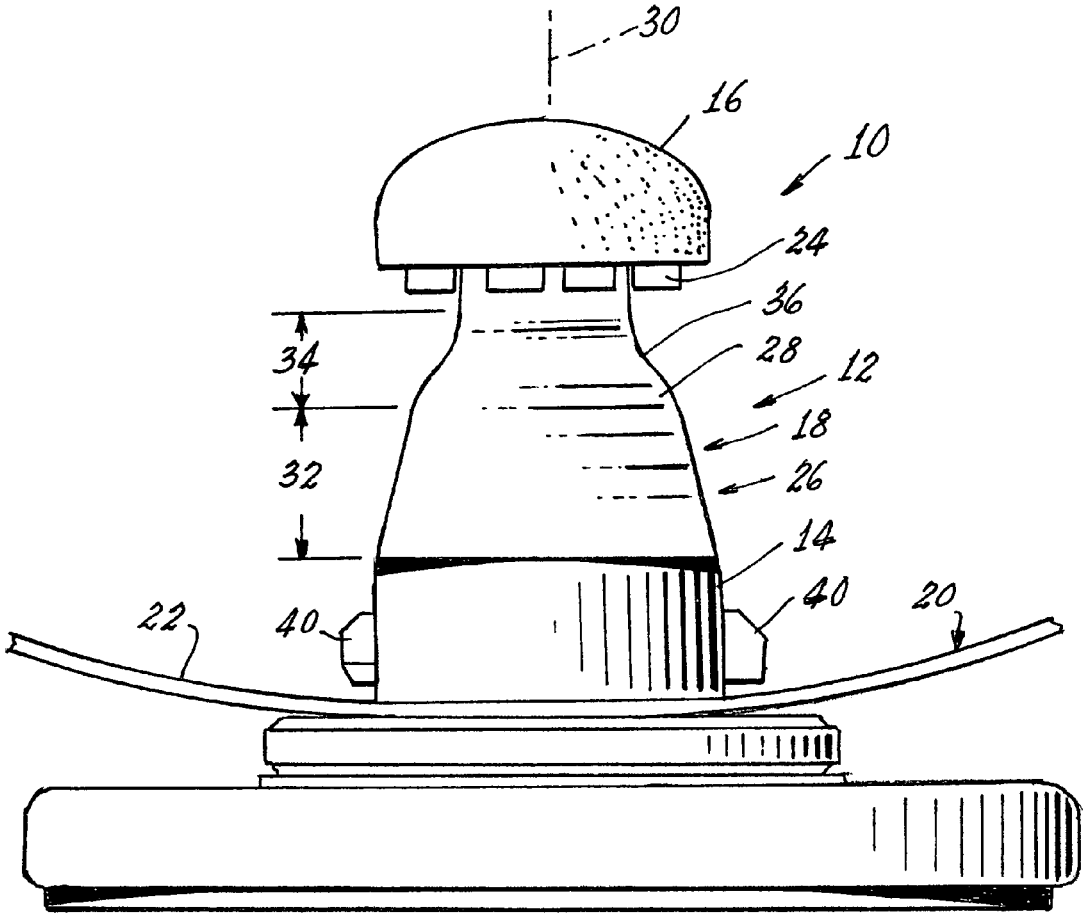
FIG. 2 is an elevational view thereof.

For a better understanding of the present invention, together with other and further objects, advantages and capabilities thereof, reference is made to the following disclosure and appended claims in conjunction with the above-described drawings.

Referring now to the drawings with grater particularity, there is shown in the figures a bulb 10 having a central stem 12 that includes a base 14, a summit 16, and an intermediate portion 18.

A parabolic reflector 20 is positioned about the base 14 and has a first reflector surface 22 facing the summit 16. At least one light source 24 is positioned on the summit 16 for directing primary illumination toward the reflector surface 22 on the reflector 20. In a preferred embodiment of the invention a plurality of light sources 24 are employed to even the distribution of light and the light sources are red light emitting LEDs.

An optic 26 is associated with at least a part of the intermediate portion 18, the optic 26 having a second reflector surface 28 for directing secondary illumination toward the first reflector surface 22.

The central stem 12 has an axis 30 and the light sources 24 are mounted normal to the axis.

The optic 26 is comprised of a wide frustum 32 and a narrow frustum 34 joined by a radius 36 and it can be an integral part of the central stem 12 or it can be a separate part that is fitted over the central stem 12. The optic 26 can be, for example, a thin, metal housing with a reflective coating thereon; however, in a preferred embodiment of the invention the optic 26 is a metallized plastic to reduce weight and cost.

The base 14 of the bulb 10 can be provided with locating and holding means such as flanges 40 for maintaining the bulb in a proper location within a reflector, as is well known in the art.

There is thus provided an efficient LED bulb for automotive applications such as taillights turn signals of stoplights. The problem of the prior art inefficient lenses is solved by the introduction of the reflector optic around the central stem. The LEDs point directly downward, i.e., toward the parabolic reflector, and the light emitted therefrom either passes the bulb optic and hits the main reflector directly or the light from the LEDs is reflected off the reflector optic to the main reflector and thus fills the angles further away from the axis.

The optic is designed such that the emission pattern is continuous and does not have two distinct parts of light emission. The LED bulb optic does not create a separate emission profile, but blends into the direct emission from the LEDs, merely extending it.

The virtual focal point of the LED ring with the LED bulb optic is not a point but a distributed cloud, which allows the use of simpler reflector optics. Thus, with a simple parabolic mirror, the LED bulb produces a beam pattern close to the brake light or turn signal beam pattern specified by SAE.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A bulb comprising:

a central stem including a base, a summit, and an intermediate portion;

a reflector positioned about said base having a first reflector surface facing said summit;

at least one light source on said summit for directing primary illumination toward said reflector surface on said reflector; and an optic associated with at least a part of said intermediate portion, said optic having a second reflector surface for directing secondary illumination toward said first reflector surface;

wherein said summit includes multiple light sources;

wherein said central stem has an axis and said light sources are mounted normal to said axis;

wherein said optic is comprised of a wide frustum and a narrow frustum joined by a radius; and wherein said optic is an integral part of said stem.

2. A bulb comprising:

a central stem including a base, a summit, and an intermediate portion;

a reflector positioned about said base having a first reflector surface facing said summit;

at least one light source on said summit for directing primary illumination toward said reflector surface on said reflector; and an optic associated with at least a part of said intermediate portion, said optic having a second reflector surface for directing secondary illumination toward said first reflector surface;

wherein said summit includes multiple light sources;

wherein said central stem has an axis and said light sources are mounted normal to said axis;

wherein said optic is comprised of a wide frustum and a narrow frustum joined by a radius; and wherein said optic is a separate part fitted over said stem.

3. The bulb of claim 2 wherein said optic is metallized plastic.

* * * * *